US009541336B2

(12) United States Patent
Beutler et al.

(10) Patent No.: US 9,541,336 B2
(45) Date of Patent: Jan. 10, 2017

(54) EVAPORATION HEAT TRANSFER TUBE WITH A HOLLOW CAVITY

(71) Applicant: WIELAND-WERKE AG, Ulm (DE)

(72) Inventors: Andreas Beutler, Weissenhorn (DE); Andreas Schwitalla, Ilerkirchberg (DE); Jianying Cao, Shanghai (CN); Zhong Luo, Shanghai (CN)

(73) Assignee: WIELAND-WERKE AG, Ulm (DE)

( * ) Notice: Subject to any disclaimer, the term of this patent is extended or adjusted under 35 U.S.C. 154(b) by 187 days.

(21) Appl. No.: 14/427,399

(22) PCT Filed: Nov. 6, 2013

(86) PCT No.: PCT/EP2013/003332
§ 371 (c)(1),
(2) Date: Mar. 11, 2015

(87) PCT Pub. No.: WO2014/072046
PCT Pub. Date: May 15, 2014

(65) Prior Publication Data

US 2015/0241140 A1 Aug. 27, 2015

(30) Foreign Application Priority Data

Nov. 12, 2012 (CN) ..... 2012 1 0451686

(51) Int. Cl.
*F28F 1/42* (2006.01)

(52) U.S. Cl.
CPC ..... *F28F 1/422* (2013.01); *F28F 2001/428* (2013.01)

(58) Field of Classification Search
CPC ..... F28F 1/40; F28F 1/42; F28F 1/422; F28F 2001/428
(Continued)

(56) References Cited

U.S. PATENT DOCUMENTS 3,684,007 A 8/1972 Ragi
6,173,762 B1 * 1/2001 Ishida ..... F28F 1/42 165/133
(Continued)

FOREIGN PATENT DOCUMENTS

CN 101004335 A 7/2007
CN 101532795 A 9/2009
(Continued)

OTHER PUBLICATIONS

International Search Report of European Patent Office issued in International Application No. PCT/EP2013/003332 dated Feb. 17, 2014 (3 pages).
(Continued)

*Primary Examiner* — Davis Hwu
(74) *Attorney, Agent, or Firm* — Flynn, Thiel, Boutell & Tanis, P.C.

(57) ABSTRACT

The present invention relates to an evaporation heat transfer tube with a hollow cavity, comprising a tube main body and at least one hollow frustum structure. Outer fins are arranged at intervals on the outer surface of the tube main body and inter-fin grooves are formed between two adjacent outer fins. The hollow frustum structure is arranged at the bottom of the inter-fin grooves and surrounded by side walls. The top of the hollow frustum structure is provided with an opening. The side walls extend inwards and upwards from the bottom of the inter-fin grooves and thus the area of the opening is less than the area of the bottom of the hollow frustum structure. The inner surface and the outer surface of the side walls are intersected at the opening to form a flange. Preferably, the flange is a sharp corner and the radius of the curvature is 0 to 0.01 mm. The side walls are formed by at least two surfaces which are connected to each other. The hollow frustum structure is hollow pyramid frustum shaped, hollow volcano shaped or hollow cone frustum shaped. The
(Continued)

height Hr and the height H of the inter-fin grooves meet the following relations: Hr/H is greater than or equal to 0.2. The present invention is ingeniously designed and concisely structured and it remarkably enhances the boiling coefficient between the outer surface of the tube and the liquid outside the tube, reinforcing the heat transfer in boiling and it is suitable for large-scale popularization and application.

12 Claims, 5 Drawing Sheets

(58) Field of Classification Search
USPC ..... 165/179, 133
See application file for complete search history.

(56) References Cited

U.S. PATENT DOCUMENTS 7,044,211 B2 * 5/2006 Insalaco ..... F28F 1/022 165/179
8,281,850 B2 10/2012 Beutler et al.
2003/0094272 A1 * 5/2003 Brand ..... B21C 37/207 165/179
2007/0251671 A1 * 11/2007 Barnes ..... F28D 1/0333 165/83
2008/0196876 A1 8/2008 Cao et al.
2008/0236803 A1 * 10/2008 Cao ..... F28F 1/36 165/179
2009/0229807 A1 9/2009 Beutler et al.

FOREIGN PATENT DOCUMENTS

DE 10 2008 013 929 B3 4/2009
EP 0 108 364 A1 5/1984
EP 0 495 453 A1 7/1992
EP 0 522 985 A1 1/1993
FR 2120091 A1 2/2014

OTHER PUBLICATIONS

Chinese Office Action issued in corresponding application No. 201380051729.5, dated May 25, 2016, with English translation thereof (13 pages).

* cited by examiner

EVAPORATION HEAT TRANSFER TUBE WITH A HOLLOW CAVITY

FIELD OF TECHNOLOGY

The present invention relates to the technical field of heat transfer devices, in particularly to the technical field of evaporation heat transfer tubes, specifically to an evaporation heat transfer tube with a hollow cavity which is utilized to enhance the heat exchange performance of the flooded evaporator and the falling film evaporator.

DESCRIPTION OF RELATED ARTS

Flooded evaporators have been widely applied in chillers for refrigeration and air-conditioning. Most of them are shell-and-tube heat exchangers wherein the refrigerant exchanges heat by phase change outside of the tube and the cooling medium or coolant (e.g. water) exchanges heat by flowing inside of the tube. It is necessary to utilize the enhanced heat transfer technology for the reason that the majority of the thermal resistance is in the side of the refrigerant. There is a plurality of heat transfer tubes designed for the evaporation phase change process of heat transfer.

FIG. 1 to FIG. 3 show the structure of the traditional heat transfer tube applied to the flooded evaporation enhancing surface. The main mechanism is to utilize the nucleate boiling theory of the flooded evaporation to carry out forming the fins, knurlings, plain rollings on the outer surface of tube main body 5 and to form bubble structures or inter-fin grooves 2 on the outer surface of the tube main body 5 by machining, thus providing a core of nucleate boiling to reinforce the evaporation heat exchange.

The structure of the traditional heat transfer tube is described as follows: outer fins 1 are distributed in a spirally elongated manner or a mutually parallel manner around the outer surface of the tube main body 5 and inter-fin grooves 2 are formed between two adjacent outer fins 1 circumferentially. Meanwhile, the rifling internal threads 3 are distributed on the inner surface of the tube main body 5, which is specifically as noted in FIG. 1. Moreover, according to the prior art, in order to form the required porous surface on the evaporation tube, normally the outer fins 1 need to be grooved and rolled on the top. The bending or flat expansion of the material of the fin top is used to form coverings with small openings 4. Such top-covered inter-fin grooves 2 with openings 4 are beneficial for heat exchange through nucleate boiling. The detailed structure is as noted in FIG. 2 and FIG. 3.

The parameters of the heat transfer tube for machining and manufacturing according to FIG. 1 are as follows:

The tube main body 5 may be formed by copper and copper alloy, or other metals; the outside diameter of the heat transfer tube is 16 to 30 millimeter, and the wall thickness of the tube is 1 to 1.5 millimeter; extrusion is carried out with a specialized tube mill and the machining is carried out both inside and outside of the tube, The spiral outer fins 1 and the inter-fin grooves 2 between two adjacent spiral outer fins 1 are circumferentially processed on the outer surface of the tube main body 5. The axial distance P between two outer fins 1 on the outer surface of the tube is 0.4 to 0.7 mm (P is the distance from the centre point of the fin width of one outer fin 1 to the centre point of the fin width of another adjacent outer fin 1). The thickness of the fin is 0.1 to 0.35 mm, and the height of the fin is 0.5 to 2 mm. Furthermore, after the machining of the heat transfer tube shown in FIG. 1, a notched groove can be formed by using the knurling knife to extrude the top material of the outer fin 1, then relatively-sealed inter-fin grooves 2 (with the opening 4) structure can be formed by the elongation of the bottom material of the notched groove as shown in FIG. 2 and FIG. 3.

Generally, it is a necessity for the heat transfer tube to be wetted on the surface by as much refrigerant as possible; furthermore, it is a necessity for the tube surface to provide more nucleation sites (by forming notches or slits on the outer surface of the machined tube) which is beneficial for nucleate boiling. Nowadays, with the development of the refrigeration and air-conditioner industry, higher demand for heat exchange efficiency of evaporators is put forward, and nucleate boiling heat exchange is required to be realized at a lower temperature difference in heat transfer. In general, in the case of lower temperature difference in heat transfer, the type of evaporation heat exchange is convective boiling. Thus the surface structure of the heat transfer tube needs to be further optimized to realize a nucleate boiling with obvious bubbles.

SUMMARY OF THE INVENTION

The object of the present invention is to overcome the drawbacks of the prior arts, providing an evaporation heat transfer tube with a hollow cavity. The evaporation heat transfer tube with a hollow cavity is ingeniously designed and concisely structured, remarkably enhancing the boiling coefficient between the outer surface of the tube and the liquid outside the tube, strengthening the heat transfer in boiling and is suitable for large-scale popularization and application.

In order to achieve above objects, the present invention of evaporation heat transfer tube with a hollow cavity comprises a tube main body, wherein outer fins are arranged at intervals on the outer surface of said tube main body, and inter-fin grooves are formed between two adjacent outer fins, wherein said evaporation heat transfer tube with a hollow cavity further comprises at least one hollow frustum structure; said hollow frustum structure is arranged at the bottom of said inter-fin grooves and said hollow frustum structure is surrounded by side walls; the top of said hollow frustum structure is provided with an opening; said side walls extend inwards and upwards from the bottom of said inter-fin grooves and thus the area of said opening is less than the area of the bottom of said hollow frustum structure; the inner surface of said side walls and the outer surface of said side walls are intersected at said opening to form a flange.

Preferably, said flange is a sharp corner and the radius of the curvature of said sharp corner is 0 to 0.01 mm.

Preferably, said side walls are formed by at least two surfaces which are connected to each other.

More preferably, the two surfaces which are connected to each other are intersected in the joint to form a sharp corner, the radius of the curvature of said sharp corner is 0 to 0.01 mm.

More preferably, said hollow frustum structure is hollow pyramid frustum shaped, hollow trapezoidal prismoid shaped, hollow quadrihedron frustum shaped, hollow volcano shaped or hollow cone frustum shaped.

Preferably, the shape of said opening is circular, oval, polygonal or crater-shaped.

Preferably, the height of said hollow frustum structure is 0.08 to 0.30 mm.

Preferably, the height Hr of said hollow frustum structure and the height H of said inter-fin grooves meet the following relations: Hr/H is greater than or equal to 0.2.

Preferably, the height Hr of said hollow frustum structure and the height H of said inter-fin grooves meet the following relations: Hr/H is greater than or equal to 0.2.

Preferably, said outer fins are distributed in a spirally elongated manner or a mutually parallel manner around the outer surface of said tube main body circumferentially; said inter-fin grooves are circumferentially formed around said tube main body.

Preferably, said outer fin has a laterally elongated body; the top of said outer fin extends laterally to form said laterally elongated body.

Preferably, internal threads are arranged on the inner surface of said tube main body.

The beneficial effects of the present invention are as follows:

1. The present invention of evaporation heat transfer tube with a hollow cavity comprises a tube main body and at least one hollow frustum structure. Outer fins are arranged at intervals on the outer surface of said tube main body and inter-fin grooves are formed between two adjacent outer fins. Said hollow frustum structure is surrounded by side walls. The top of said hollow frustum structure is provided with an opening. Said side walls extend inwards and upwards from the bottom of said inter-fin grooves and thus the area of said opening is less than the area of the bottom of said hollow frustum structure. The inner surface of said wall and the outer surface of said side wall are intersected at the opening to form a flange. Thus, the flange is beneficial to increase the nucleation sites in the cavity and raise the superheating temperature of the liquid in the cavity, thus the nucleate boiling heat exchange is reinforced. Meanwhile, with the hollow frustum structure, the heat exchange area is increased, thus the boiling heat transfer coefficient is significantly increased at a lower temperature difference. It is ingeniously designed and concisely structured and it remarkably enhances the boiling coefficient between the outer surface of the tube and the liquid outside the tube, reinforcing the heat transfer in boiling and is suitable for large-scale popularization and application.

2. The side walls of the evaporation heat transfer tube with a hollow cavity of the present invention are formed by at least two surfaces which are connected to each other. The two surfaces which are connected to each other are intersected in the joint to form a sharp corner, and the radius of the curvature of said sharp corner is 0 to 0.01 mm, and thus it is beneficial to increase the nucleation sites in the cavity and raise the superheating temperature of the liquid in the cavity, and thus the nucleate boiling heat exchange is reinforced. Meanwhile, with the hollow frustum structure, heat exchange area is increased, thus the boiling heat transfer coefficient is significantly increased at a lower temperature difference. It is ingeniously designed and concisely structured and it remarkably enhances the boiling coefficient between the outer surface of the tube and the liquid outside the tube, and it reinforces the heat transfer in boiling and is suitable for large-scale popularization and application.

DETAILED DESCRIPTION OF THE PREFERRED EMBODIMENT

In order to have a better understanding of the technical content, the present invention is further exemplified by the following detailed description of embodiments.

Figure 1:
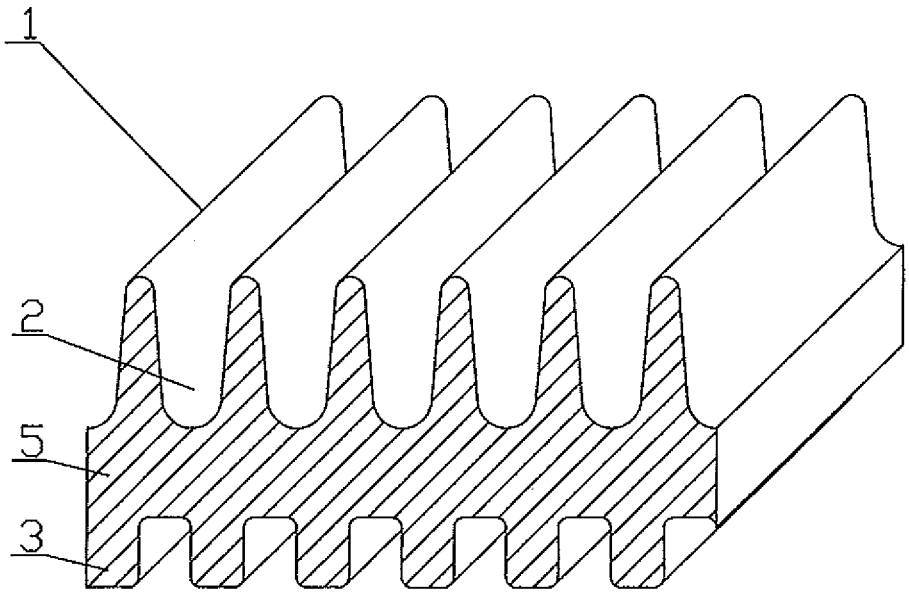
FIG. 1 is a cross sectional schematic diagram in the axial direction illustrating the first embodiment of the traditional heat transfer tube with fins.
Figure 2:
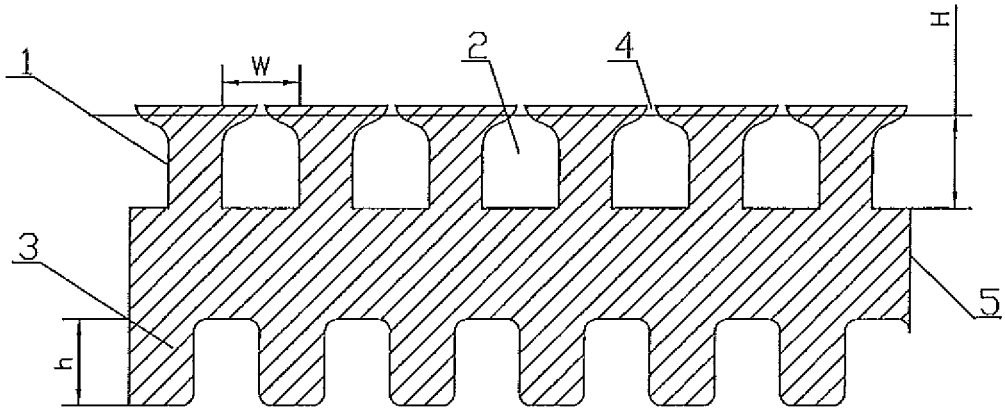
FIG. 2 is a cross sectional schematic diagram in the axial direction illustrating the second embodiment of the traditional heat transfer tube with fins.
Figure 3:
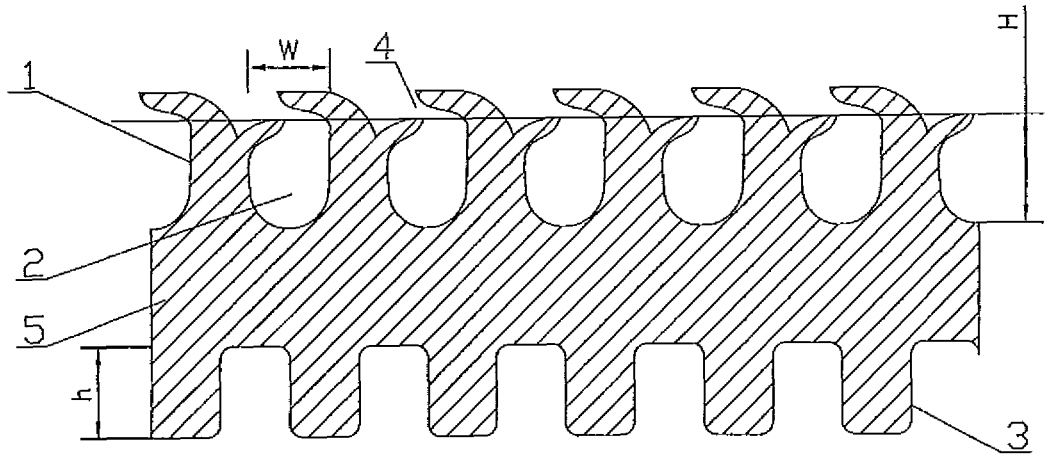
FIG. 3 is a cross sectional schematic diagram in the axial direction illustrating the third embodiment of the traditional heat transfer tube with fins.

According to the nucleate boiling mechanism, on the basis of the structure noted in FIG. 1, FIG. 2 and FIG. 3, studies have found that it is more beneficial to form the needed nucleate sites for nucleate boiling if a hollow frustum structure 6 which is surrounded by side walls 6 and has opening on the top is formed on the bottom 21 of the inter-fin grooves 2.

Figure 4:
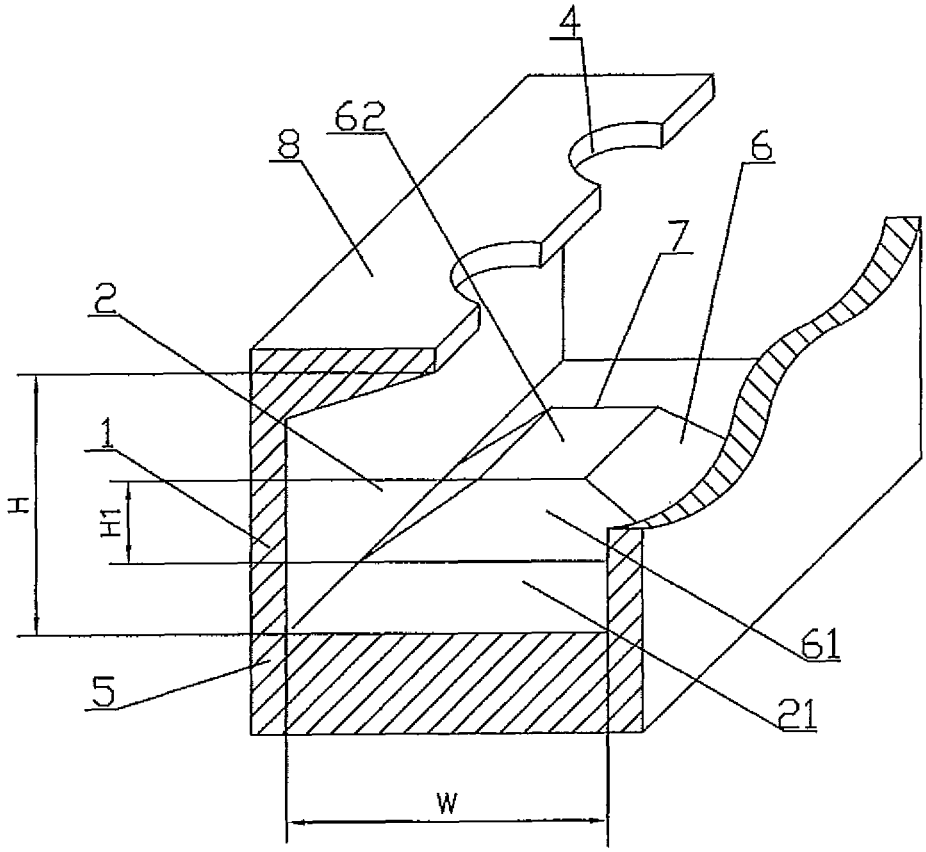
FIG. 4 is a fragmentary perspective view of a schematic diagram of the first embodiment according to the present invention.

FIG. 4 is a view schematically perspective view showing the cavity structure on the outer surface of the tube main body 5 according to the first embodiment of the present invention. As shown in FIG. 4, the inter-fin grooves 2 are covered by the top which is formed by the relative elongation of the laterally elongated body 8 of neighboring outer fins 1. By extruding the bottom material of the cavity through a mould at the bottom 21 of the inter-fin grooves 2, a hollow frustum structure 6 which is surrounded by side walls 61 and has an opening 62 on the top can be formed. The area of the opening 62 is less than the area of the bottom. The specific shape of said hollow frustum structure 6 is a pyramid with truncated top. Hence the shape of the opening 62 is rectangular. Obviously, the shape of the opening can be circular, oval, or other polygons such as an irregular polygon composed by two curves or can be crater-shaped due to different shapes of the hollow frustum structure 6. In a further aspect, the side walls 61 are formed by four surfaces which are connected to each other (not shown). The two surfaces which are connected to each other are intersected in the joint to form a sharp corner, and the radius of the curvature of said sharp corner is 0 to 0.01 mm, e.g. 0.005 mm. In a further aspect, the inner surface of side walls 61 and the outer surface the side walls 61 are intersected at the opening 62 to form a flange 7, The flange is a sharp corner.

The radius of curvature of said sharp corner is 0 to 0.01 mm, e.g. 0.005 mm. The specified radius of curvature of the sharp corner is 0 to 0.01 mm, illustrating that the position in which two planes are intersected is discontinuous transition or non-smooth transition to form a sharp turn. The flange 7 is beneficial to increase the nucleate sites and the superheating temperature of the liquid in the cavity. Thus the nucleate boiling heat transfer is reinforced, and the heat exchange area is increased at the same time. Consequently, the boiling heat transfer coefficient is increased by more than 25% at a lower temperature difference. According to the present invention, the height HI of the hollow frustum structure 6 at the bottom 21 of the inter-fin groove 2 is 0.08 to 0.30 mm. In a further aspect, the side walls of the two sides of the inter-fin grooves 2 are not part of the side walls 61 of the hollow frustum structure 6. The side walls 61 surrounding the hollow frustum structure 6 extend from the bottom 21 of the inter-fin groove 2 towards the top of the inter-fin groove 2 and draw close to the middle of the inter-fin groove 2 horizontally. In a further aspect, the height Hr (i.e. H1 mentioned above) of the hollow frustum structure 6 and the height H of the inter-fin groove 2 meet the following relation: Hr/H is greater than or equal to 0.2, wherein the height of the inter-fin groove 2 is the height of the outer fin 1 or the distance between the centre point of the opening 4 (namely the opening 4 is the slit formed by the relative elongation of the lateral elongated body 8 of the neighboring outer fin 1) on the top of the inter-fin groove 2 and the bottom 21 of the inter-fin groove 2 (when the top of the inter-fin groove 2 is the covered by the top of elongated materials).

Figure 5:
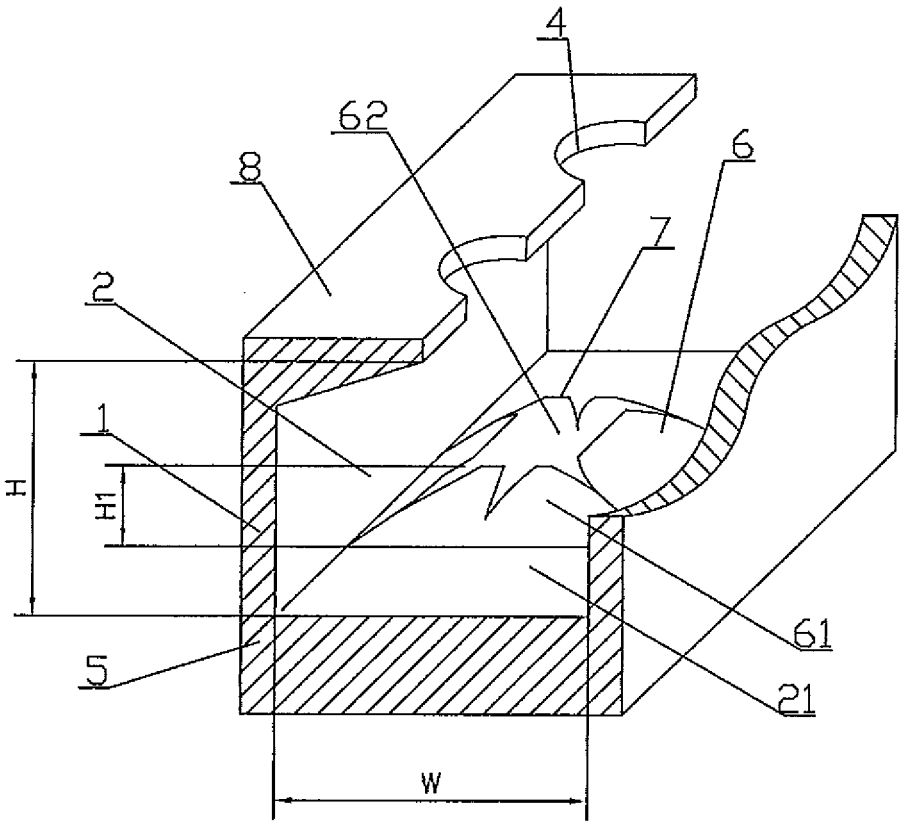
FIG. 5 is a fragmentary perspective view of a schematic diagram of the second embodiment according to the present invention.

FIG. 5 is a perspective view schematically showing the cavity structure on the outer surface of the tube main body 5 according to the second embodiment of the present invention. As shown in FIG. 5, the hollow frustum structure 6 is shaped like a volcano. In the practice of production, since the material is formed by extrusion, the edge of the opening 62 on the top may not be fully moulded. Then the shape of the hollow frustum structure 6 is similar to the volcano, and the opening 62 of the top of the hollow frustum structure 6 is similar to the crater with a downwardly and outwardly extended jagged edge. When the hollow frustum structure 6 is shaped like a volcano, the flange 7 is shaped similarly like the edge of the petal. Other features are the same as the embodiment shown in FIG. 4.

Figure 6:
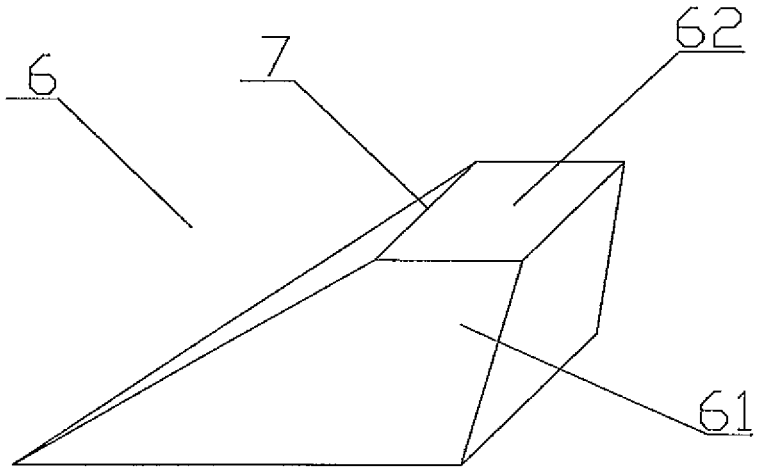
FIG. 6 is a schematic perspective diagram of the third embodiment of the hollow frustum structure according to the present invention.

FIG. 6 is a perspective view schematically showing the hollow frustum structure 6 according to the third embodiment of the present invention. As shown in FIG. 6, the hollow frustum structure 6 may also be shaped like a hollow trapezoidal frustum with the truncated top. Then, the shape of the opening 62 is rectangular.

Figure 7:
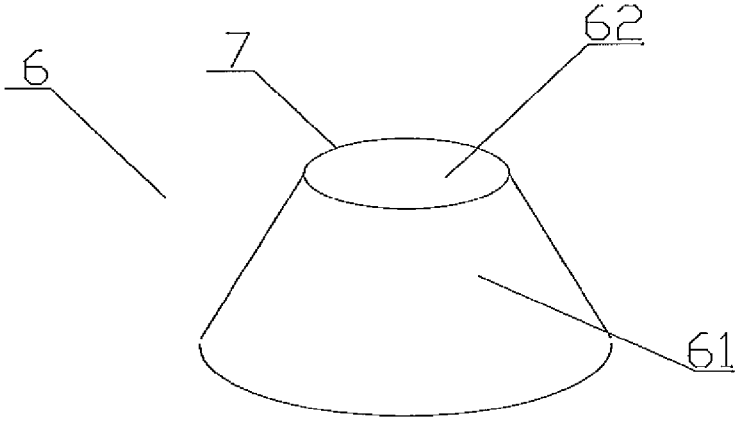
FIG. 7 is a schematic perspective diagram of the fourth embodiment of the hollow frustum structure according to the present invention.

FIG. 7 is a perspective view schematically showing the hollow frustum structure 6 according to the fourth embodiment of the present invention. As shown in FIG. 7, the hollow frustum structure 6 may also be shaped like a hollow cone frustum with the truncated top. Then, the shape of the opening 62 is circular. Furthermore, the hollow frustum structure 6 may also be shaped like hollow quadrihedron frustum platform. Then the shape of the opening 62 is triangular.

According to the present invention, internal threads (not shown) can be machined on the inner surface of the tube main body 5 by using a profiled mandrel in order to reinforce the heat exchange coefficient inside the tube. The higher the internal threads are, the bigger the number of the starts of the thread is, and the more powerful the capability of heat transfer augmentation inside the tube becomes, while the more fluid resistance there will be inside the tube. Hence according to the first embodiment mentioned above, the height of the internal threads is all 0.36 mm and the angle C between the internal thread and the axis is 46 degree. The number of the starts of the thread is 38. These internal threads are able to reduce the thickness of the boundary layer of heat transfer, thus the convective heat transfer coefficient can be increased. In a further aspect, the total heat transfer coefficient is increased.

Figure 8:
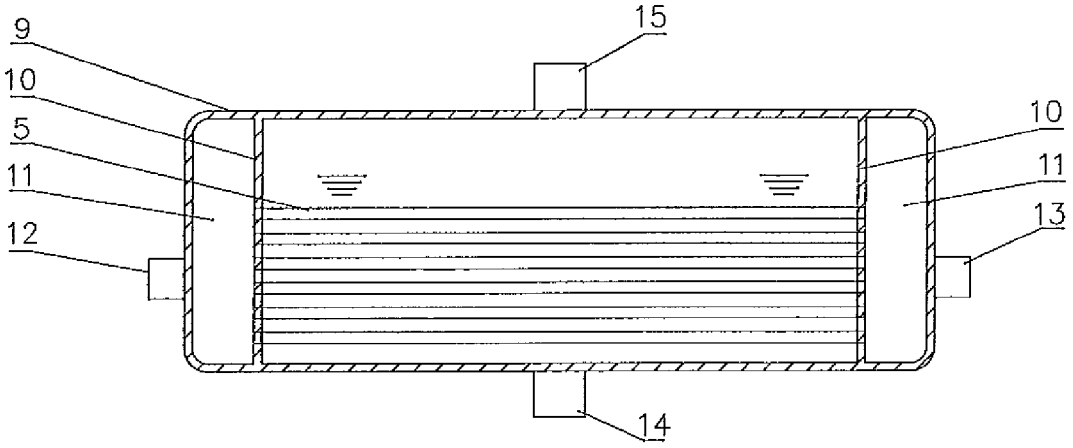
FIG. 8 is a front sectional schematic diagram of the evaporation heat transfer tube with a hollow cavity when applied in the flooded evaporator according to the present invention.

The operation of the present invention in the heat exchanger is as follows:

As shown in FIG. 8, the tube main body 5 of the present invention is fixed on the tube plate 10 of the heat exchanger 9 (evaporator). The cooling medium (e.g. water) flows from the inlet 12 of the water chamber 11 through the tube main body 5, exchanging the heat with the refrigerant outside the tube main body, then, then flowing out from the outlet 13 of the water chamber 11. The refrigerant flows into the heat exchanger 9 from the inlet 14 and submerse the tube main body 5. The refrigerant is evaporated into gas by the heating of the external wall of the tube and it flows out of the heat exchanger 9 from the outlet 15. The cooling medium inside the tube is cooled since the evaporation of the refrigerant is endothermic. Consequently, the boiling heat transfer coefficient is effectively increased thanks to the structure of the outer wall of the said tube main body 5 which is beneficial for reinforcing the nucleate boiling of the refrigerant.

However, on the inner wall of the tube main body 5, the internal thread structure is beneficial to increase the heat exchange coefficient inside the tube, thus increasing the overall heat exchange coefficient, consequently enhancing the performance of the heat exchanger 9 and reducing the consumption of the metal.

Figure 9:
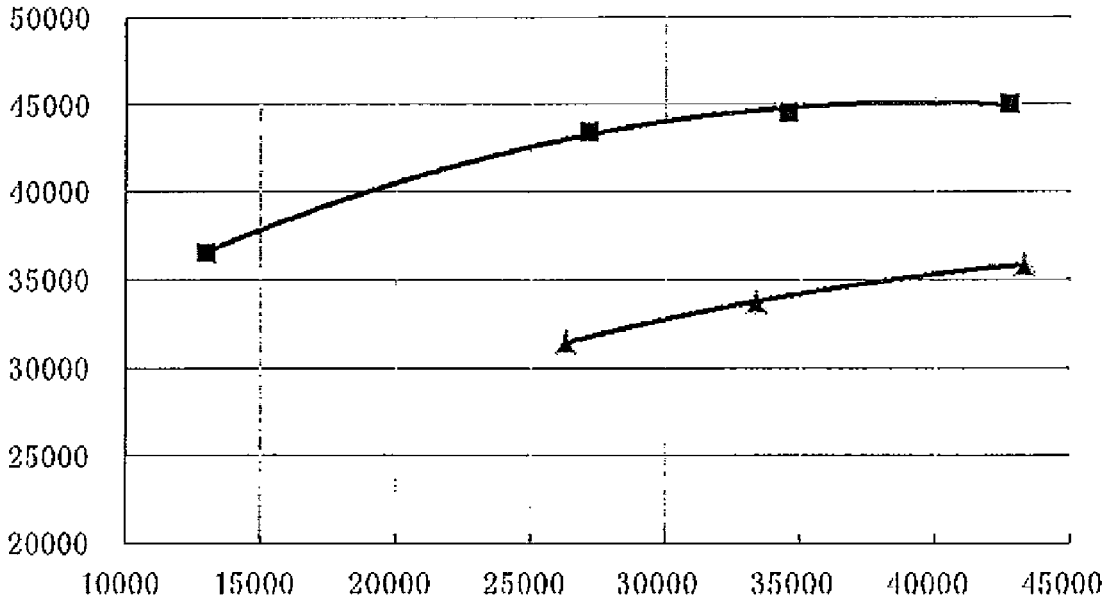
FIG. 9 is the variation graph of boiling heat transfer coefficient outside of the tube of heat transfer tube over heat flux, determined by experimenting the evaporation heat transfer tube with a hollow cavity according to the present invention and the evaporation heat transfer tube according to the prior art.

Please refer to FIG. 9, a test for the performance of boiling heat transfer of the evaporation heat transfer tube with a hollow cavity manufactured according to the present invention is carried out. The tested evaporation heat transfer tube with a hollow cavity is manufactured according to the first embodiment. The outer fins 1 on the tube main body 5 are spiral fins. The outside diameter of the tube main body 5 with the outer fins 1 is 18.89 mm; the height H of the inter-fin groove is 0.62 mm and the width W is 0.522 mm. The hollow frustum structure 6 is pyramid shaped with the truncated top. Four surfaces of the side wall 61 which are connected to each other are intersected in the joint to form four sharp corners. The radius of the curvature of said sharp corners is 0.005 mm. A flange 7 is formed at the opening 62 by the inner surface of the side walls 61 and the outer surface of the side walls. The flange 7 is a sharp corner and the radius of the curvature of said sharp corner is 0.005 mm. The height H1 of the hollow frustum structure 6 is 0.2 mm and the width is 0.522 mm. The internal threads are trapezoidal threads, wherein the height h is 0.36 mm and the pitch of the threads is 1.14 mm; the angle C between the thread and the axis is 46 degree; the number of the starts of the thread is 38. In contrast, the hollow frustum structure is not machined on the bottom of the inter-fin grooves 2 of another heat transfer tube. As noted in FIG. 9, the result of the test shows the comparison of the boiling heat transfer coefficients outside the tube between the evaporation heat transfer tube with a hollow cavity manufactured according to the present invention and the evaporation heat transfer tube manufactured according to the prior art. The test conditions are as follows: the refrigerant is R134a; the saturation temperature is 14.4° C. the flow rate of the water inside the tube is 1.6 m/s. In the figure, the abscissa represents the heat flux ($W/m^2$), and the ordinate represents the total heat transfer coefficient ($W/m^2K$). The solid squares represent the evaporation heat transfer tube with a hollow cavity manufactured according to the present invention, while the solid triangles represent the evaporation heat transfer tube of the prior art. Thus it can be seen, thanks to the added hollow frustum structure 6, the performance of heat transfer of the evaporation heat transfer tube with a hollow cavity according to the present invention has an obvious enhancement compared with the prior art.

Normally, increasing the surface roughness greatly enhances the heat flux of the nucleate boiling state. The reason is that the rough surface has a plurality of cavities to capture vapor which provides much more and much bigger space for the nucleation of the bubbles. During the growth of the bubbles, thin liquid film is formed along the inner wall of the inter-fin grooves 2, and the thin liquid film rapidly produces a plurality of vapor by evaporation. By machining the hollow frustum structure 6 at the bottom 21 of the inter-fin groove 2, the present invention has the following advantages for evaporation heat transfer:

1. Increasing the roughness of the bottom 21 of the inter-fin groove 2 and increasing the surface area;

2. Reducing the thickness of the liquid film in the cavities by the sharp corner formed by the hollow frustum structure 6; in a further aspect, reinforcing the boiling of the partial liquid film. Comparative test shows that if the radius of the curvature of the sharp corner is less than 0.01 mm, the heat exchange effect will be quite obvious, being increasing by more than 5%.

3. The slit structure formed by the hollow frustum structure 6 in the cavity is beneficial for increasing the cores of the nucleate boiling, thus cooperating to reinforce the boiling heat exchange of the whole cavity.

To sum up, the evaporation heat transfer tube with a hollow cavity of the present invention is ingeniously designed and concisely structured and it remarkably enhances the boiling coefficient between the outer surface of the tube and the liquid outside the tube, reinforces the heat transfer in boiling and is suitable for large-scale popularization and application.

In this specification, the present invention has been described with the reference to its specific embodiments, However, it is obvious still may be made without departing from the spirit and scope of the present invention, various modifications and transformation. Accordingly, the specification and drawings should be considered as illustrative rather than restrictive.

The invention claimed is:

1. An evaporation heat transfer tube with a hollow cavity comprises a tube main body;

outer fins are arranged at intervals on the outer surface of said tube main body and inter-fin grooves are formed between two adjacent outer fins, wherein said evaporation heat transfer tube with a hollow cavity further comprises at least one hollow frustum structure; said hollow frustum structure is arranged at the bottom of said inter-fin grooves and the said hollow frustum structure is surrounded by side walls; the top of the said hollow frustum structure is provided with an opening; said side walls extend inwards and upwards from the bottom of said inter-fin grooves and thus the area of said opening is less than the area of the bottom of said hollow frustum structure; the inner surface of said side walls and the outer surface of said side walls are intersected at said opening to form a flange.

2. An evaporation heat transfer tube with a hollow cavity according to claim 1, wherein said flange is a sharp corner and the radius of the curvature of said sharp corner is 0 to 0.01 mm.

3. An evaporation heat transfer tube with a hollow cavity according to claim 1, wherein said side walls are formed by at least two surfaces which are connected to each other.

4. An evaporation heat transfer tube with a hollow cavity according to claim 3, wherein the two surfaces which are connected to each other are intersected in the joint to form a sharp corner, and the radius of the curvature of said sharp corner is 0 to 0.01 mm.

5. An evaporation heat transfer tube with a hollow cavity according to claim 1, wherein said hollow platform structure is hollow pyramid frustum shaped, hollow trapezoidal prismoid shaped, hollow quadrihedron frustum shaped, hollow volcano shaped or hollow cone frustum shaped.

6. An evaporation heat transfer tube with a hollow cavity according to claim 1, wherein the shape of said opening is circular, oval, polygonal or crater-shaped.

7. An evaporation heat transfer tube with a hollow cavity according to claim 1, wherein the height of said hollow frustum structure is 0.08 to 0.30 mm.

8. An evaporation heat transfer tube with a hollow cavity according to claim 1, wherein the height Hr of said hollow frustum structure and the height H of said inter-fin grooves meet the following relations: Hr/H is greater than or equal to 0.2.

9. An evaporation heat transfer with a hollow cavity according to claim 1, wherein part of said side walls extends from the edge of said bottom which is adjacent to the side walls of said inter-fin grooves.

10. An evaporation heat transfer tube with a hollow cavity according to claim 1, wherein said outer fins are distributed in a spirally elongated manner or a mutually parallel manner around the outer surface of said tube main body circumferentially; said inter-fin grooves are circumferentially formed around said tube main body.

11. An evaporation heat transfer tube with a hollow cavity according to claim 1, wherein said outer fin has a laterally elongated body; the top of said outer fin extends laterally to form said laterally elongated body.

12. An evaporation heat transfer tube with a hollow cavity according to claim 1, wherein internal threads are arranged on the inner surface of said tube main body.

* * * * *